US006351070B1

(12) United States Patent
Barry

(10) Patent No.: US 6,351,070 B1
(45) Date of Patent: Feb. 26, 2002

(54) LAMP WITH SELF-CONSTRICTING PLASMA LIGHT SOURCE

(75) Inventor: Jonathan Barry, Frederick, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 09/472,983

(22) Filed: Dec. 28, 1999

(51) Int. Cl.[7] ..... H01J 7/46
(52) U.S. Cl. ..... 315/39; 315/248
(58) Field of Search ..... 315/39, 248, 267, 315/344; 313/634

(56) References Cited

U.S. PATENT DOCUMENTS

| | | | | | |
|---|---|---|---|---|---|
| 4,042,850 | A | | 8/1977 | Ury et al. | 315/39 |
| RE32,626 | E | | 3/1988 | Yoshizawa et al. | 315/39 |
| 5,334,913 | A | * | 8/1994 | Ury et al. | 315/248 |
| 5,361,274 | A | | 11/1994 | Simpson et al. | 372/72 |
| 5,471,109 | A | * | 11/1995 | Gore et al. | 313/22 |
| 5,686,793 | A | * | 11/1997 | Turner et al. | 315/344 |
| 5,838,108 | A | * | 11/1998 | Frank et al. | 315/39 |
| 5,841,233 | A | * | 11/1998 | Ury et al. | 315/248 |
| 5,866,990 | A | | 2/1999 | Ury et al. | 315/248 |
| 6,031,333 | A | * | 2/2000 | Simpson | 315/39 |
| H1876 | H | * | 10/2000 | Knox et al. | 313/634 |

OTHER PUBLICATIONS

Kabouzi et al.; Radial Contraction of Atmospheric Pressure Discharges Sustained by a Surface Wave at 915 and 2450 MHz; CIP '99; Jun. 6–10, 1999; pp. 197–201.
Offermanns, Stephan; Resonance Characteristics of a Cavity–Operated Electrodes High–Pressure Microwave Discharge System; IEEE;vol. 38,No. 7,Jul. 1999.
Dupret et al.; Highly efficient microwave coupling devices for remote plasma applications; 1994 American Inst. Of Physics; pp. 3439–3443.

* cited by examiner

*Primary Examiner*—Don Wong
*Assistant Examiner*—Thuy Vinh Tran
(74) *Attorney, Agent, or Firm*—Shlesinger, Arkwright & Garvey LLP

(57) ABSTRACT

A microwave-powered lamp comprises a microwave source; a non-resonant microwave cavity operably coupled to the microwave source, the microwave cavity being substantially cylindrical about a centerline; an elongated bulb disposed along the centerline of the microwave cavity; and a reflector operably associated with the bulb to direct radiation generated by the bulb to a product being cured. The bulb may be enclosed by a solid barrier such that cooling gas used for the bulb is isolated from the curing environment. The microwave cavity is separate from the function of focusing the radiation output from the bulb so that changes to the optical system can be made without also modifying the microwave cavity.

24 Claims, 3 Drawing Sheets

LAMP WITH SELF-CONSTRICTING PLASMA LIGHT SOURCE

FIELD OF THE INVENTION

The present invention relates generally to UV lamps used for treating photopolymerizable films, and specifically to microwave-powered lamps where the microwave cavity is independent of the optical system.

BACKGROUND OF THE INVENTION

UV radiation is used to photochemically polymerize (cure) relatively thin films on various surfaces. The established technology for performing the polymerization generally comprises either an electrode or microwave-powered ultraviolet lamp, as disclosed, for example, in U.S. Pat. No. 4,042,850. The electrode or microwave power is dissipated in a plasma-filled bulb. The component elements of the plasma are chosen primarily to radiate light at some desirable wavelength or range(s) of wavelengths. In general, the plasma-filled bulb is situated in an optical system that has the desired effect of focusing the UV light in a manner that improves the efficiency of a given process.

In the case of a typical microwave-powered lamp, one or more magnetrons are used to generate microwave power, which is then fed into a microwave cavity containing the plasma-filled bulb. The microwave cavity serves the dual purpose of containing substantially all the microwave energy and focusing the UV light output from the bulb. Thus, if a new optical system is desired, the properties of the microwave cavity must also change. Typically, designing a new microwave cavity that also meets the new optical requirements is a highly cumbersome task and, in practice, it is more common to alter the polymerization process rather than altering the optical/microwave system.

Typical microwave-powered UV lamps operate in a regime of very high power densities, where several hundred watts of microwave power may be absorbed by the plasma in a relatively small volume. Due to inherent inefficiencies in the plasma, some of the microwave power is converted to heat and dissipated in the walls of the bulb, a phenomenon known as "wall loading". Wall loading imposes the restriction that, in typical operation, the plasma-filled bulb must be cooled by some external means to prevent overheating and promote long bulb life. Normally, this is accomplished by circulating air or some other coolant over the surfaces of the bulb. The operable power density of a given plasma-filled bulb is limited by the surface area of the bulb and the available practical means for removing heat from that surface.

In some instances, it is desirable to run a photopolymerization or other light sensitive process in an environment other than air. Such instances can include those where the light sensitive process is also undesirably chemically sensitive to one or more of the gaseous elements that are present in air, such as oxygen. Another instance can be where the optimum wavelength of light for a given process may not be readily transmitted through air. This portion of the light spectrum is usually referred to as "vacuum UV". Instances such as these are often referred to as the "inerted processes" due to the required presence of some inert gas or vacuum between the light source and the process.

OBJECTS AND SUMMARY OF THE INVENTION

It is an object of the present invention to provide microwave-powered lamp where the microwave cavity is separate from the optical system to allow for rapid adaption of the lamp to any reasonable optical system.

It is another object of the present invention to provide a microwave-powered lamp that constricts the plasma toward the center of the bulb, thereby reducing the temperature of the bulb envelope to allow operation at much higher power densities.

It is still another object of the present invention to provide a microwave-powered lamp where the cooling system for the bulb is separate from the curing atmosphere, thereby allowing for application in an inerted or vacuum UV process.

In summary, the present invention provides a microwave-powered lamp, comprising a microwave source; a microwave cavity operably coupled to said microwave source, the microwave cavity being substantially cylindrical about a centerline; an elongated bulb disposed along the centerline of the microwave cavity; and a reflector operably associated with the bulb to direct radiation generated by said bulb to a product being cured. The bulb may be enclosed by a solid barrier such that cooling gas used for cooling the bulb is isolated from the curing environment. The microwave cavity is separate from the function of focusing the radiation output from the bulb so that changes to the optical system can be made without also modifying the microwave cavity.

These and other objects of the present invention will become apparent from the following detailed description.

BRIEF DESCRIPTIONS OF THE DRAWINGS

DETAILED DESCRIPTION OF THE INVENTION

Figure 1:
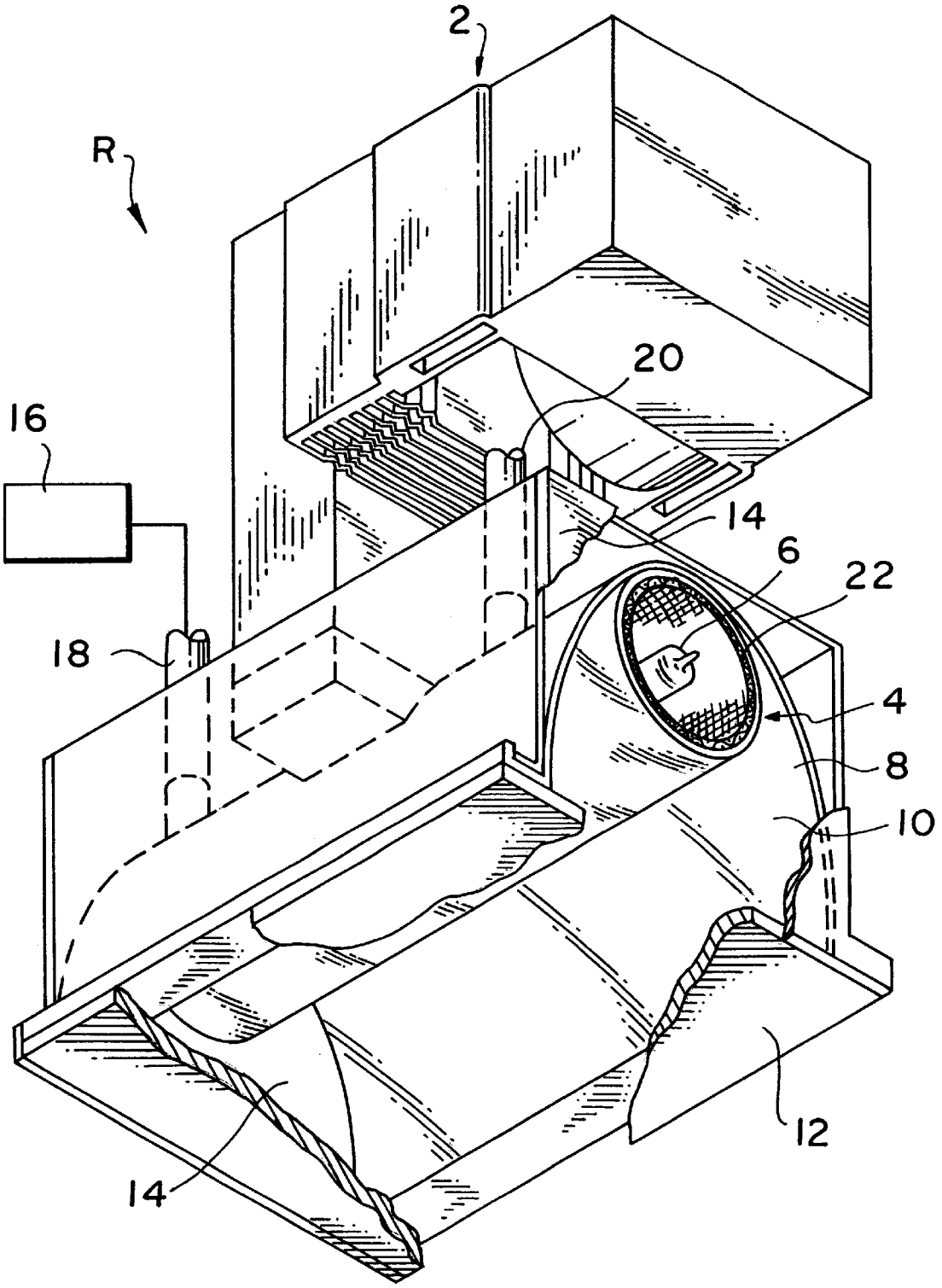
FIG. 1 is a bottom perspective view, with portions broken away, of a lamp made in accordance with the present invention.

A lamp R made in accordance with the present invention is disclosed in FIG. 1. The lamp R comprises a magnetron 2 operably coupled to a microwave cavity 4 within which a bulb 6 is disposed. The bulb contains a fill, which is excited by the microwave power, to generate a plasma (see FIG. 4) and curing radiation, such as ultraviolet radiation. The microwave cavity 4 is associated with an optical reflector 8 for directing the radiation generated by the bulb 6 towards a product (not shown) being cured. The reflector cavity 10 may be enclosed by a clear quartz plate 12 to prevent fouling of the reflector surface by by-products of the curing process. Side plates 14 enclose the ends of the reflector cavity 10 and the microwave cavity 4. The side plates 14 also provide a structure for supporting the bulb 6 (see FIG. 3) within the microwave cavity.

The bulb 6 and the microwave cavity 4 may be of any practical diameter, length or cross-section to suit the specific optical system.

A source of pressurized air 16 or any suitable gas or fluid is used to cool the bulb 6. Pressurized air is directed into the microwave cavity 4 through an inlet opening 18 and is exhausted through an outlet opening 20. The microwave cavity 4 is advantageously isolated from the curing environment to prevent curing gases generated during the curing process from possibly condensing on the bulb envelope and thereby reduce its transmissive efficiency. The isolated microwave cavity 4 also permits use of relatively less expensive air, as compared to pure nitrogen, which may be used in an inert atmosphere requiring exclusion of air during the curing process.

Figure 3:
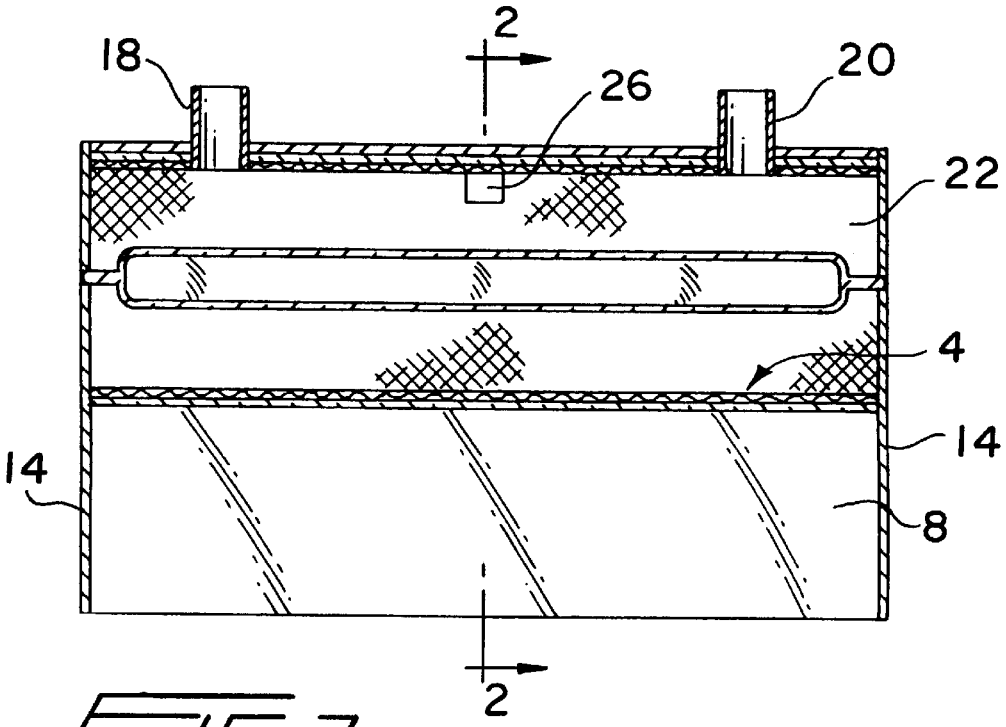
FIG. 3 is a cross-sectional view taken along line 3—3 of FIG. 2.
Figure 2:
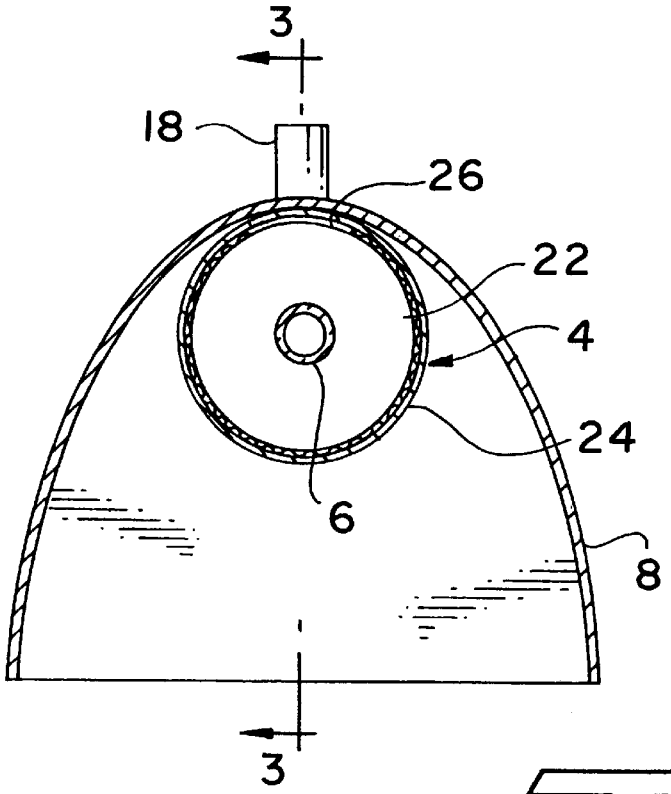
FIG. 2 is a cross-sectional view taken along line 2—2 of FIG. 3.

The microwave cavity 4 is in the shape of a hollow cylinder made from a wire mesh 22 that is opaque to microwaves but transparent to UV radiation, as best shown in FIG. 2. A quartz tube 24 may be used, disposed concentrically with and outside or inside the wire mesh 22, for inerted process applications so that the bulb 6 is enclosed within a separate chamber where cooling air may be used, instead of the generally more expensive inert gas used for the curing atmosphere. The bulb 6, which is elongated, is disposed along the centerline of the cylindrical microwave cavity 4, as best shown in FIGS. 2 and 3.

The cavity 4 operates in a TM-like mode and is non-resonant. The radius of the microwave cavity 4 is preferably made as small as practicable so that it will fit within an elliptical reflector 8 and still keep the bulb 6 coincident with the focal line of the reflector. For a microwave source at 2.45 GHz, a cavity radius of about 0.925" was found to fit within an elliptical reflector 3.1" tall and 4.4" wide in cross-section. For comparison, a resonant cylindrical cavity for a 2.45 GHz microwave system would have a radius of approximately 1.83".

Figure 4:
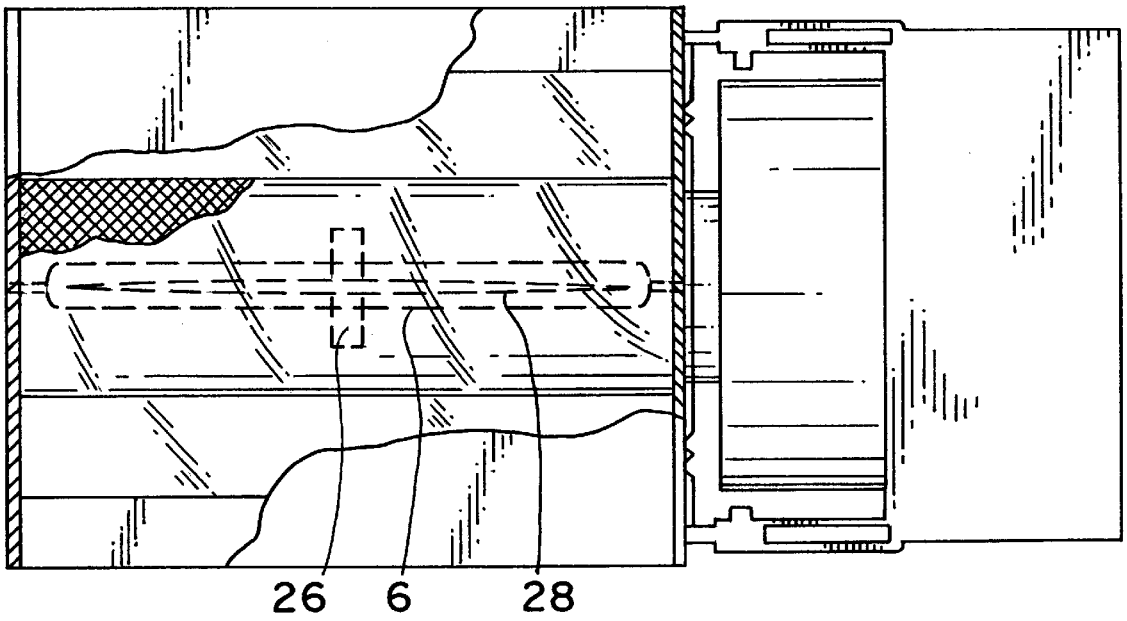
FIG. 4 is a bottom view of FIG. 1, with portions broken away.

Microwave power is coupled into the microwave cavity 4 via a microwave applicator, such as the slot iris 26 in the wire mesh 22, as best shown in FIG. 4, or dipole antennas (not shown).

Referring to FIG. 4, the plasma 28 is constricted to the central portion of the bulb 6. This has the desirable effect of substantially reducing the temperature of the bulb envelope, thereby allowing operation at much higher power densities.

By separating the microwave cavity from the optical system, rapid adaptation to any reasonable optical system can be made. Since changes to the reflector geometry can be made independent of the microwave cavity, the optical characteristics of the lamp can easily be changed to suit the polymerization process.

To cause plasma constriction to the central portion of the bulb 6 and away from the bulb envelope, the bulb 6 must be concentric with the microwave cavity geometry.

The reflector 8 is preferably elliptical in cross-section with a focal point, in cross-section, at which the bulb 6 is disposed.

Figure 5:
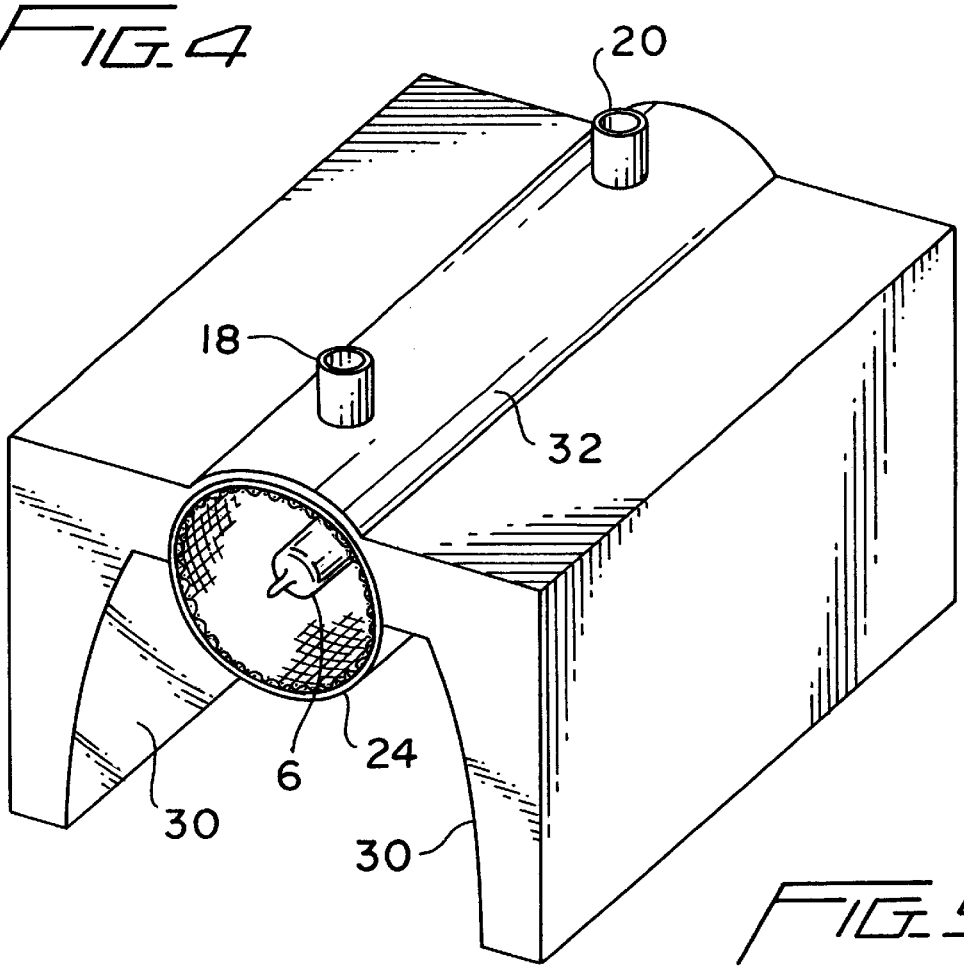
FIG. 5 is a perspective view of another embodiment of the lamp of the present invention, showing a truncated elliptical reflector.

The reflector does not have to be a complete ellipse, as best shown in FIG. 5. A truncated elliptical reflector 29 is shown in FIG. 5 where the bulb 6 is disposed along its focal line. The quartz tube 24 preferably includes a reflecting coating 32 in an area not covered by the reflector surfaces 30.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A microwave-powered lamp, comprising:

a) a microwave source;

b) a non-resonant microwave cavity operably coupled to said microwave source, said microwave cavity being substantially cylindrical about a centerline;

c) an elongated bulb disposed along the centerline of said microwave cavity; and d) a reflector operably associated with said bulb to direct radiation generated by said bulb to a product being cured.

2. A microwave-powered lamp as in claim 1, and further comprising:

a) radiation transparent tube adapted to receive therewithin said bulb;

b) inlet and outlet openings communicating with said tube; and c) a source of cooling fluid or gas operably associated with said inlet opening for cooling said bulb.

3. A microwave-powered lamp as in claim 2, wherein:

a) said microwave cavity includes a cylindrical wire mesh; and b) said wire mesh is disposed within said tube.

4. A microwave-powered lamp as in claim 2, wherein:

said tube is quartz.

5. A microwave-powered lamp as in claim 2, wherein:

a) said tube is concentric with said microwave cavity.

6. A microwave-powered lamp as in claim 1, wherein:

a) said reflector defines a reflector cavity; and b) a radiation transmissive plate enclosing a bottom portion of said reflector cavity.

7. A microwave-powered lamp as in claim 1, wherein;

a) said reflector is elliptical in cross-section.

8. A microwave-powered lamp as in claim 7, wherein:

a) said reflector is a truncated ellipse in cross-section.

9. A microwave-powered lamp as in claim 1, wherein:

a) said microwave cavity is cylindrical.

10. A microwave-powered lamp as in claim 1, wherein:

a) said tube includes a portion disposed outside the reflective confines of said reflector; and b) said portion includes a reflective surface.

11. A microwave-powered lamp as in claim 1, wherein:

a) said bulb includes a fill suitable for generation of UV radiation.

12. A microwave-powered lamp, comprising:

a) a microwave source;

b) a microwave cavity operably coupled to said microwave source;

c) an elongated bulb disposed within said microwave cavity;

d) a solid barrier fully enclosing said bulb;

e) inlet and outlet openings through said solid barrier to admit cooling fluid inside said barrier to cool said bulb and exhaust the cooling fluid, respectively, said barrier being effective to isolate the cooling fluid from a product being cured;

f) a source of cooling fluid operably associated with said inlet opening; and g) a reflector operably associated with said bulb to direct radiation generated by said bulb to the product being cured.

13. A microwave-powered lamp as in claim 12, wherein:

a) said solid barrier includes a tube transmissive to the radiation of said bulb.

14. A microwave-powered lamp as in claim 13, wherein:

a ) said tube is quartz.

15. A microwave-powered lamp as in claim 13, wherein:

p1 a) said tube is concentric with said microwave cavity.

16. A microwave-powered lamp as in claim 12, wherein:

a) said solid barrier defines said microwave cavity.

17. A microwave-powered lamp as in claim 16, wherein:

a) said solid barrier includes a quartz tube and a wire mesh disposed within said tube.

18. A microwave-powered lamp, comprising:

a) a microwave source;

b) a non-resonant microwave cavity operably coupled to said microwave source;

c) an elongated bulb disposed within said microwave cavity;

d) a reflector operably associated with said bulb to direct radiation generated by said bulb to a product being cured; and e) said reflector being separate from said microwave cavity such that said reflector can be modified without modifying said microwave cavity.

19. A microwave-powered lamp as in claim 18, wherein:

a) said reflector is elliptical in cross-section; and b) said microwave cavity is disposed within said reflector.

20. A microwave-powered lamp as in claim 18, wherein:

a) said reflector is a truncated ellipse in cross-section.

21. A microwave-powered lamp as in claim 18, wherein:

a) said microwave cavity is a tubular wire-mesh.

22. A microwave-powered lamp as in claim 21, wherein:

a) said microwave cavity is cylindrical.

23. A microwave-powered lamp as in claim 18, and further comprising:

a) a solid barrier enclosing said bulb.

24. A microwave-powered lamp, comprising:

a) a microwave source;

b) a microwave cavity operably coupled to said microwave source;

c) an elongated bulb disposed within said microwave cavity;

d) a solid barrier enclosing said bulb;

e) inlet and outlet openings through said solid barrier;

f) a source of cooling fluid operably associated with said inlet opening for cooling said bulb, said barrier being effective to isolate the cooling fluid from a product being cured;

g) a reflector operably associated with said bulb to direct radiation generated by said bulb to the product being cured; and h) said solid barrier including a tube transmissive to the radiation of said bulb.

* * * * *